US005644878A

United States Patent [19]

Wehrmann

[11] Patent Number: 5,644,878

[45] Date of Patent: Jul. 8, 1997

[54] REUSABLE FINISH TRIM FOR PREFABRICATED CLEAN ROOM WALL SYSTEM

[75] Inventor: Gary Wehrmann, San Antonio, Tex.

[73] Assignees: Sony Corporation, Japan; Sony Electronics Inc.

[21] Appl. No.: 371,375

[22] Filed: Jan. 11, 1995

[51] Int. Cl.[6] ..... E04B 2/06

[52] U.S. Cl. ..... 52/287.1; 52/282.1; 52/235; 52/482; 52/483.1; 52/489.1; 52/489.2; 52/716.8; 52/745.1; 52/745.12

[58] Field of Search ..... 52/489.2, 489.1, 52/483.1, 482, 281, 282.1, 235, 765, 766, 716.8, 800.12, 745.1, 745.12

[56] References Cited

U.S. PATENT DOCUMENTS

| | | | |
|---|---|---|---|
| 3,274,739 | 9/1966 | Gregoire | 52/282.1 X |
| 3,553,915 | 1/1971 | Passovoy | 52/489.1 X |
| 3,974,608 | 8/1976 | Grearson | 52/282.1 X |
| 4,018,020 | 4/1977 | Sauer et al. | 52/489.1 X |
| 4,189,885 | 2/1980 | Fritz | 52/282.1 |
| 4,373,304 | 2/1983 | Howitt | 52/282.1 X |
| 4,667,579 | 5/1987 | Daw | 52/79.1 X |
| 4,909,013 | 3/1990 | Daw et al. . | |
| 4,933,109 | 6/1990 | Yamada et al. | 252/520 |
| 4,984,400 | 1/1991 | Bockmiller . | |
| 5,010,702 | 4/1991 | Daw et al. . | |
| 5,199,235 | 4/1993 | Holkenbrink et al. . | |

OTHER PUBLICATIONS

Diagram of a Floating Head construction for a cleanroom, DAW Incorporated, Salt Lake, Utah 84107, 1993.

Various diagrams of Types of Clean Room Walls, DAW Incorporated, Salt Lake City, Utah 84107, 1993.

*Primary Examiner*—Christopher T. Kent

*Attorney, Agent, or Firm*—Ronald P. Kananen

[57] ABSTRACT

In order to simplify the quick and easy re-construction of a clean room which is constructed of prefabricated panels that are adapted to be connected to stud members, and to avoid the use of screws and bonds, a trim system which features a plurality of different trims is provided. By selecting a suitable trim from the plurality, and fitting it onto an edge of a panel by way of a channel or receiving portion provided thereon, it is possible to use existing studs and double finger T-clips to combine a variety of different panels together while taking advantage of a propriety type connection flanges which may be formed on some of the panels which are available.

19 Claims, 14 Drawing Sheets

REUSABLE FINISH TRIM FOR PREFABRICATED CLEAN ROOM WALL SYSTEM

BACKGROUND OF THE INVENTION

1. Field of the Invention

The present invention relates generally to clean room constructions for electronics or biomedical, manufacturing or research institutions. More specifically, the present invention relates to a trim arrangement which allows trim members to be selected and quickly and easily fitted onto panels without the need for bonding or the need to be fastened with screws, and which can be removed and re-used when the clean room layout is changed to accommodate new requirements.

2. Description of the Related Art

Presently, when constructing clean room walls in which there is a corner at a junction of two walls, a corner angle molding is glued to the wall material to seal and dress the corner of the two intersecting wall panels. This construction, however, usually prevents the reuse of the panels and molding associated with such corner construction. An alternative arrangement is such that the corner angle moldings are fastened with screws. However, this technique suffers from the drawback that the insertion and removal of the screws creates microfine particles during installation or renovating of the panels and thus gives rise to a high possibility of contamination.

FIGS. 1 and 2 show an example of a conventional corner angle construction. In this example, an outside corner trim 50 is used to interconnect two 0.5" aluminum panels 52. As will be appreciated, the panels 52 are connected to two vertically extending double sided aluminum studs 54, by way of wall panel clips 56. In order to prevent contamination through gaps which inevitably occur in such circumstances, foam gaskets 58 are disposed in the illustrated positions. An inside corner trim 60 is shown fastened to the panels by way of screws 62.

FIGS. 3 to 12 show various different types of wall panels and modules which can be used with the connection with a so-called "studless wall system". FIG. 3 shows a solid panel 70; FIG. 4 shows a single door module 72; FIG. 5 shows a double door module 74; FIG. 6 shows a window panel 76; FIG. 7 shows an auto door module 78; FIG. 8 shows an air return panel 80; FIG. 9 shows a pre-wired panel 82; FIG. 10 shows a solid door 84; FIG. 11 shows a half glazed door 86; and FIG. 12 shows a full glazed door 88. As will be appreciated, these panels can be relatively complex in nature and therefore relatively expensive. In the event that the panels have other members bonded permanently to them, each time a change in floor plan or layout occurs, considerable waste is apt to occur. This, of course, leads to an increase in cost in that many panels usually cannot be recycled unless the exact same corner construction is required.

FIGS. 13 to 17 show various types of structural fasteners and transition elements which are used in the above-mentioned "studless wall system", to provide connections between the wall panels and ceilings and floors of the building in which the clean room is being constructed. FIG. 13 shows a head track 90 which is fastened to an existing ceiling or the like and used to establish a connection with the upper edges of the panels which are used to form the walls. FIG. 14 shows a floor track 92 which is used along the lower edges of the panels. FIG. 15 shows a I/O corner tube 94 while FIGS. 16 and 17 respectively show a three piece batten set 96 and a glazing batten set 98 which use screws to establish a connection between the inner and outer members.

Clean rooms tend to require a considerable amount of so-called "bulkhead" equipment which extend through the walls of the clean room. As this equipment is usually very expensive and delicate, it is inevitably stored in a safe place while the construction or renovation of the clean room(s) is actually taking place. This means that, in order to complete the wall structure, it is necessary to install temporary panels and when the layout is basically completed, bring the production equipment in. However, this means that a number of the wall panels and associated constructions must be in part removed or torn down in order to allow the equipment to be moved into the required positions and the panels which accommodate the bulkheading arrangements to be installed in place of the temporary ones. This, of course, complicates construction and leads to wasteful and time consuming construction and reconstruction types of operations. It also opens up the clean room environment to contamination. Even when screws are used in place of bond, the structures still require that the screws be removed to allow a panel or panels to be removed or replaced so as to allow ingress and installation of the production equipment. The screws must then be reinserted.

As mentioned above, the use of screws tends to create micro-fine particles which are highly apt to create problems in the clean room environment. In order to eliminate this contamination problem, it has been proposed to use snap-in types of connectors and to provide trim members which can be pressed and secured in place without the need for screws to keep them in place. FIGS. 18 and 19 show a trim 100 which has been proposed for use with a stud based wall system. As will be clearly appreciated from FIG. 18, this trim 100 includes a barbed member 101 which is adapted, as shown in FIG. 19, to fit in between the fingers 102 of a springy T-shaped clip member 104, a support arm 106 and a seal seat 108. As shown in FIG. 19, the T-shaped clips 104 are arranged to be slipped into a T-channel groove 110 which extends along the length of one face of a stud 112. These clips are typically about 6" long and are spaced at intervals along the length of the stud 112 which is approximately 8' in length. The support arm 106 is arranged to rest against an edge portion of the stud 112, while the seal seat 108 is arranged to engage an elastomeric rope 114 or the like, in a manner which seals off the gap which tends to be produced between the edge of the trim 100 and the existing wall or structure 116 in which the prefabricated structure is being erected.

However, during the development of this invention, it was discovered that the trim arrangement 100 shown in FIG. 18 suffers from a number of drawbacks. The most disconcerting of these is that the trim tends to rotate about the barb 101*a* which is retained in the clip 104, and thus open up a clearance between the trim 100 and the outer surface of the wall panel 118. Apart from being unsightly, it tends to open a gap through which contamination can find its way into the interior of the clean room.

SUMMARY OF THE INVENTION

It is an object of the present invention to provide a trim arrangement which features a number of different trim members which can be fitted onto wall panels and the like, and which can be readily removed and reused when a change in the wall layout is required in order to expand or renovate the existing clean room facilities.

It is a further object of the present invention to provide a trim arrangement which enables panels having integral propriety type connection flanges to be connected with plain panels which are not provided with such connection flanges.

It is yet another object of the invention to provide a trim arrangement which allows panels produced by different manufacturers, which have different thicknesses, or which are formed of different materials such as glass, and the like, to be interconnected with the minimum of trouble and time.

In brief, the above objects are achieved in a prefabricated system wherein the panels are adapted to be connected to stud members, through the use of a trim system which features a plurality of different trims. By selecting a suitable trim from the plurality, and fitting it onto an edge of a plain edge panel using a channel or receiving portion provided on each of the trims, it is possible to combine a variety of different panels together while still taking advantage of propriety-type connection flanges which may be formed on some of the panels which are available, and making use of existing structure and double finger T-clips.

A first aspect of the present invention resides in a clean room which features: a plurality of different trim members, the plurality of trim members being so constructed and arranged that a selected one may be used to interconnect a selected one of a plurality of wall panels to a structural stud, each of the trim members having a channel portion in which a edge of a wall panel can be inserted.

A second aspect of the present invention resides in a clean room construction which features: a stud; a wall panel which is located adjacent the stud; a clip member which is detachably connected with the stud; and a trim having a channel shaped receiving portion which is fitted onto a edge of the panel, the trim having a barbed portion which is arranged to be received by the clip member and to be detachably retained in a predetermined spatial relationship with the stud.

A third aspect of the invention resides in a method of constructing a clean room of prefabricated panels and stud members comprising the steps of: fitting a trim having a channel-like receiving portion onto an edge of a panel; connecting a clip having a pair of resilient fingers to a stud; and forcing a barbed portion of the trim between the resilient fingers of the clip in a manner to detachably connect the panel to the stud.

A fourth aspect of the invention resides in a trim for use in a clean room construction wherein prefabricated panels are connected to studs, comprising: a channel-like receiving portion which is adapted to fit along an edge of a panel; and a barbed portion which extends essentially parallel to an end wall of the channel-like receiving portion, the barbed portion being adapted to be inserted between springy fingers of a clip which is detachably connected with a stud.

A fifth aspect of the present invention resides in a clean room wall system comprising: panel means; support means to which the panel means is connected; trim means for dressing an edge of the panel means, the trim means including a channel-like receiving portion which receives an edge of the panel; and connection means for connecting the trim means to the support means, the trim means being constructed and arranged so that in combination with the connection means, assembly of the clean room can be achieved without the use of bond or screws.

BRIEF DESCRIPTION OF THE DRAWINGS

The present invention will become more clearly appreciated as a description of the preferred embodiment is made with reference to the appended drawings in which.

FIG. 18 is a plan view of a previously proposed trim member which, as discussed in the opening paragraphs of the disclosure, can be used to complete a wall construction where it joins an existing building wall or the like;

DETAILED DESCRIPTION OF THE PREFERRED EMBODIMENTS

FIGS. 20 to 25 show examples of trim members which can be used in accordance with the present invention. As will be appreciated, all of these trim members are provided with a channel or receiver portion into which an edge of a panel can be inserted. This allows each of the trim members to be slipped into place on an edge of a panel and then set in place during assembly of the clean room walling.

Figure 20:
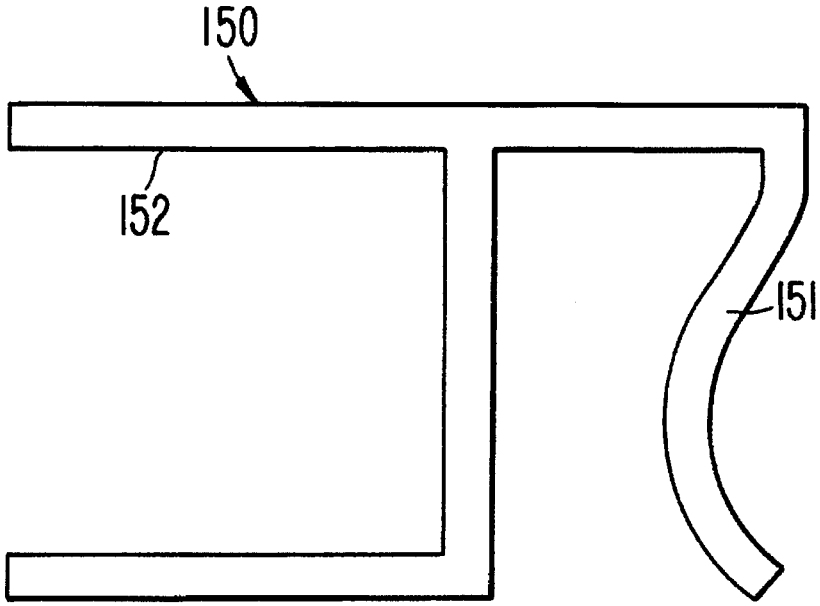
FIG. 20 is a plan view showing a first embodiment of a trim member according to the present invention.
Figure 21:
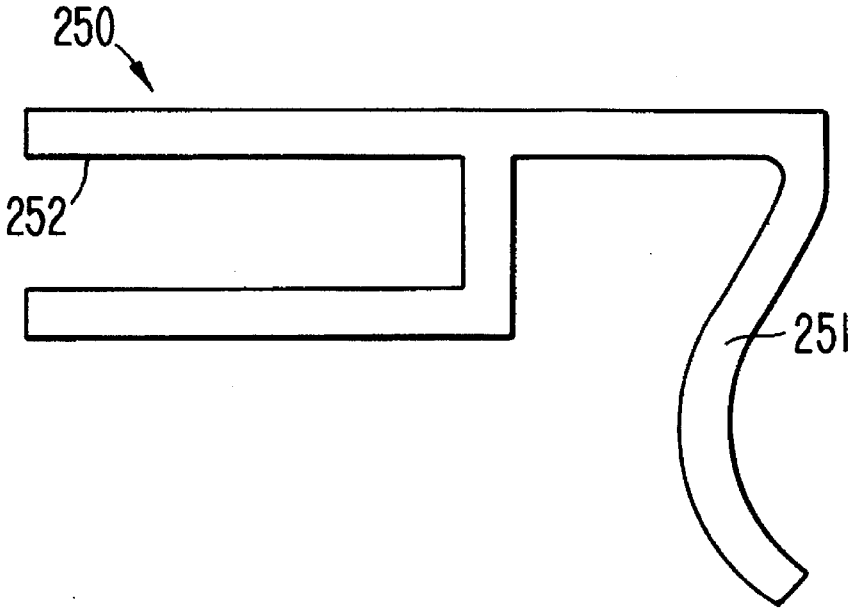
FIG. 21 is a plan view showing a second embodiment of a trim member according to the present invention.
Figure 22:
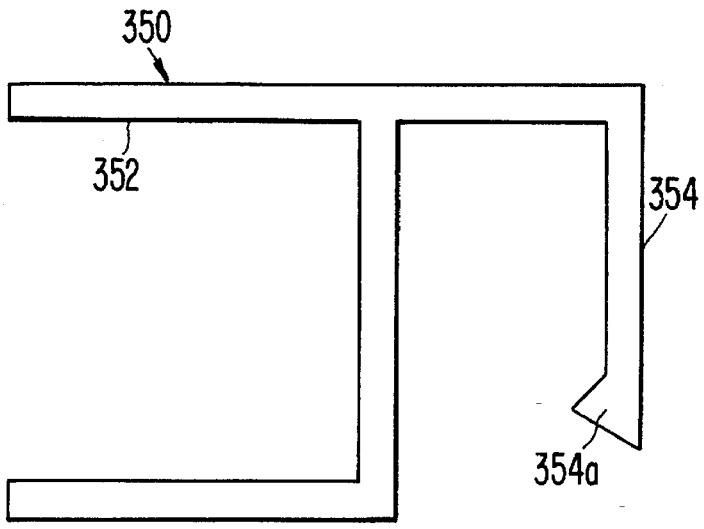
FIG. 22 is a plan view showing a third embodiment of a trim member according to the present invention.
Figure 23:
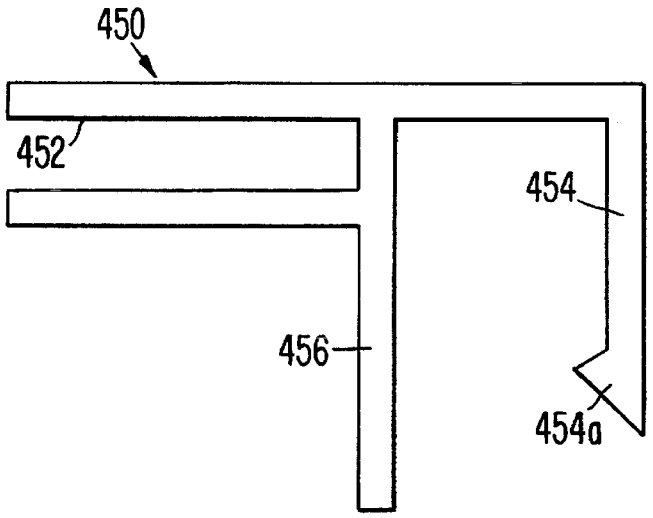
FIG. 23 is a plan view showing a fourth embodiment of a trim member according to the present invention.
Figure 25:
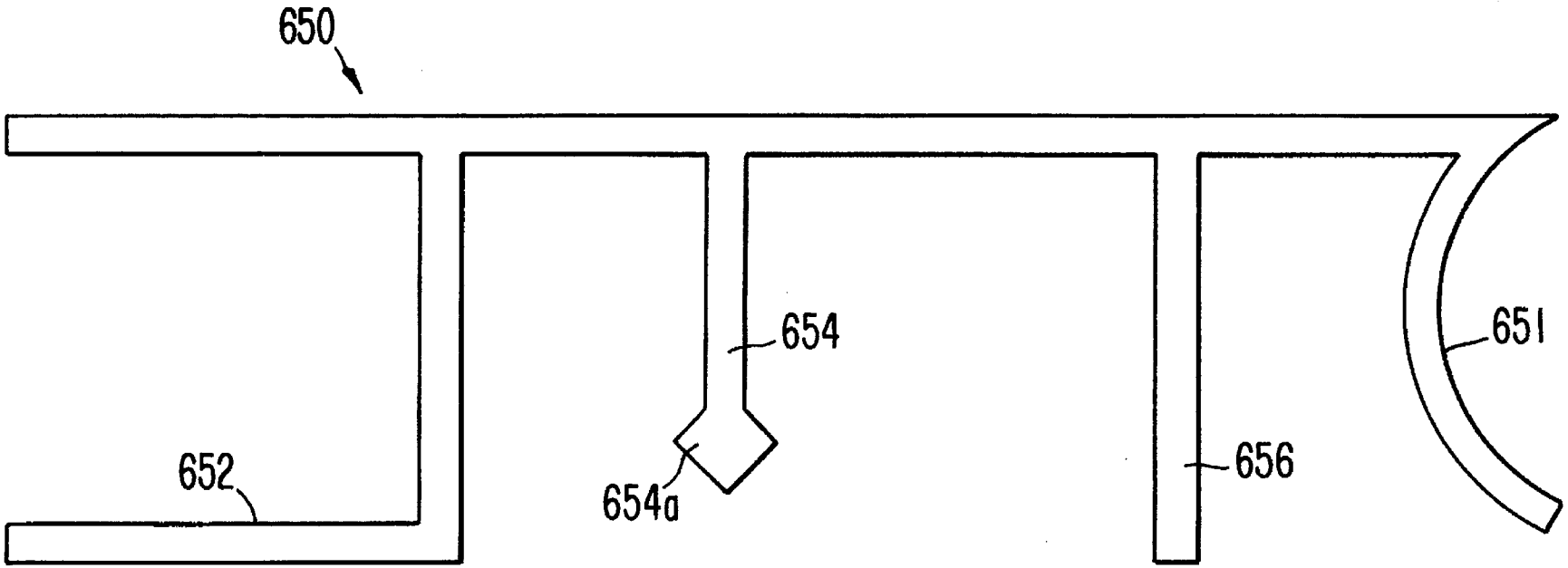
FIG. 25 is a plan view showing a sixth embodiment of a trim member according to the present invention.

FIGS. 20 and 21 show wall end cap trim members 150, 250 which are respectively provided with seal seats 151, 251. The channel member 152 of the wall end cap trim shown in FIG. 20 is adapted to receive a 0.5" panel while the trim member 250 shown in FIG. 21 has a channel member 252 which is adapted to receive a panel which is 0.25" thick. This latter mentioned trim can be used with glass panels as well as opaque panels. These embodiments of the invention may be used about apertures through which bulkheading of equipment takes place, wherein a snug seal between the equipment and trim is required, and wherein some form of connection means such as a stud and clip arrangement of the nature which is set forth in more detail with the embodiments shown in FIGS. 22, 23 and 25, are not available. By seating a suitable sealing member in the seal seat of the selected trim, e.g. a silicon rope or the like, the gap between the apparatus and the trim can be securely closed off.

FIGS. 22 and 23 show wall end cap trims 350, 450 which are respectively provided with barbed connection members 354, 454, wherein the barbs 354*a*, 454*a* are located at remote ends of the connection members 354, 454. The trim 450 shown in FIG. 23 has a channel member 452 which is designed to receive panels having a 0.25" thickness. This trim 450 is also provided with a support arm 456. The reason for this provision will become more apparent when a discussion of a specific example of the trims is made in conjunction with the arrangement shown in FIG. 31 for example.

Figure 24:
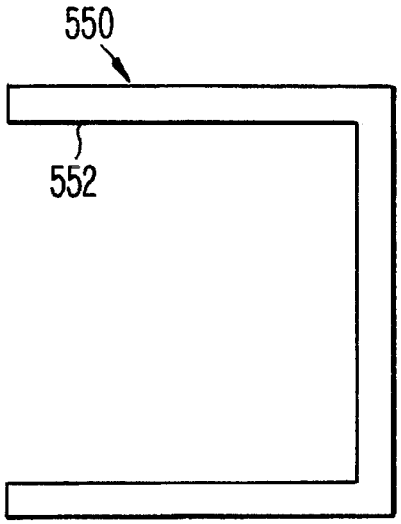
FIG. 24 is a plan view showing a fifth embodiment of a trim member according to the present invention.

FIG. 24 shows a bulkhead end cap trim 550 which is used to enclose the edge of a door opening or the like type of aperture which is required to be made through a wall panel in order to facilitate the installation of production equipment and the like.

Figure 1:
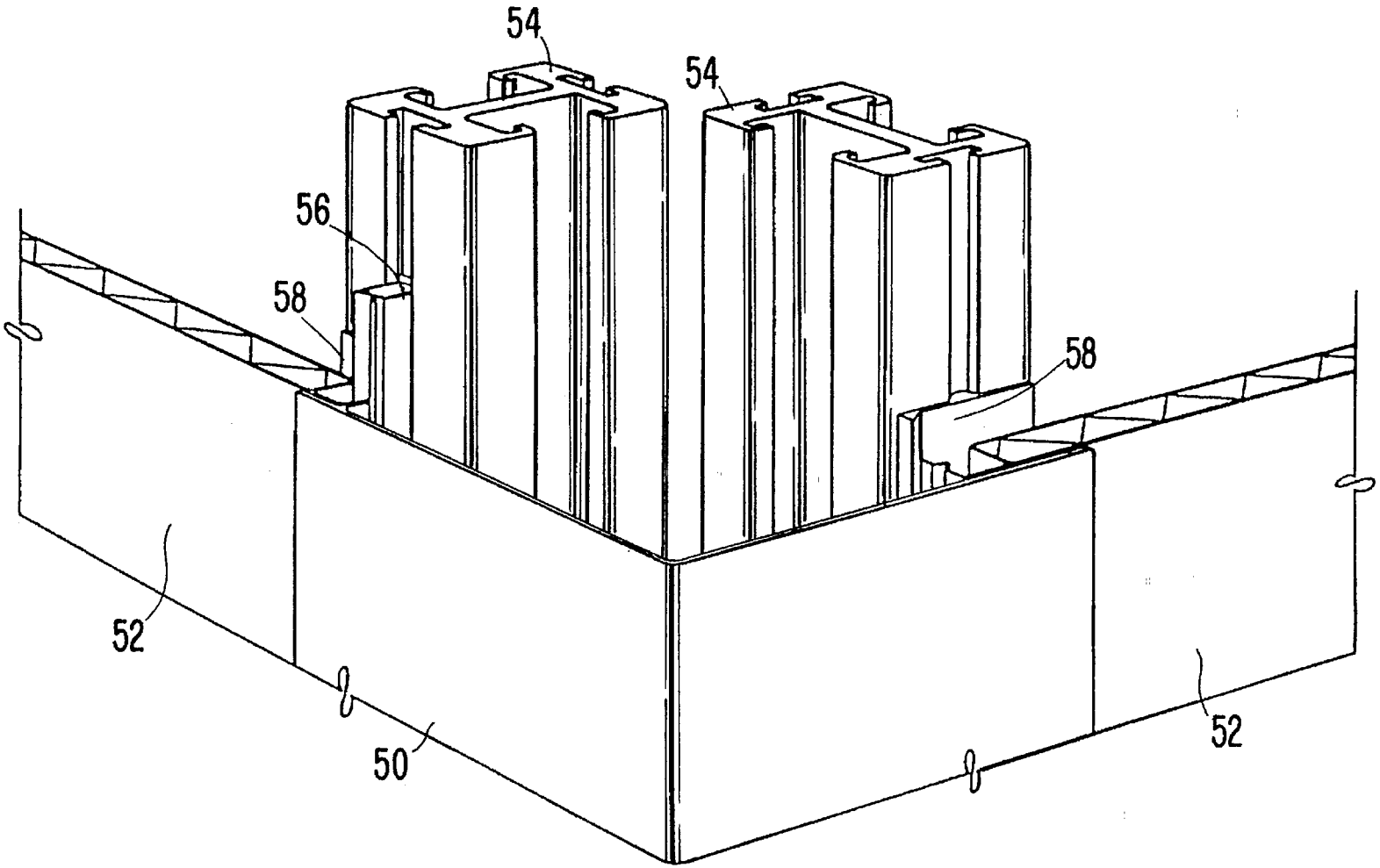
FIG. 1 (PRIOR ART)
FIG. 1 is an external perspective view showing a previously proposed wall construction arrangement suitable for use with clean rooms.
Figure 2:
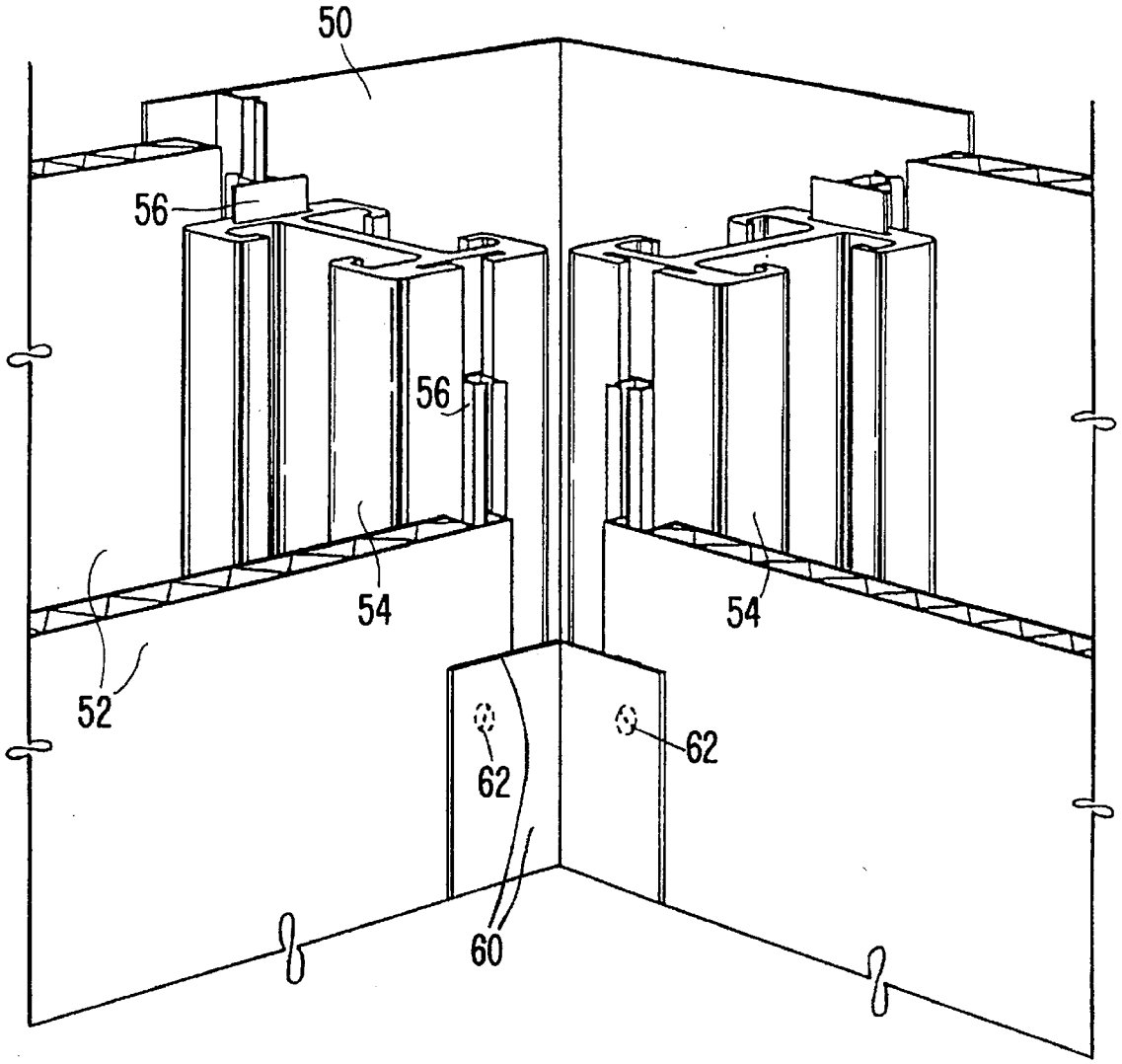
FIG. 2 (PRIOR ART)
FIG. 2 is an internal perspective view of the arrangement shown in FIG. 1.
Figure 3:
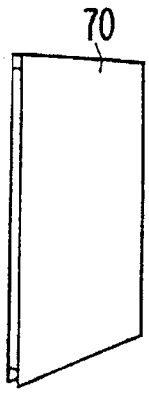
FIG. 3 (PRIOR ART)
FIG. 3 is a perspective view of a solid door which can be used with a so called "studless wall system" to form a clean room.
Figure 4:
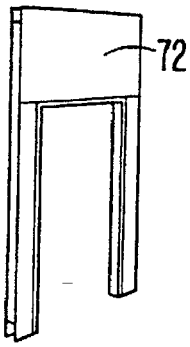
FIG. 4 (PRIOR ART)
FIG. 4 is a perspective view of a single door module which can be used with the so called "studless wall system" to form a clean room.
Figure 5:
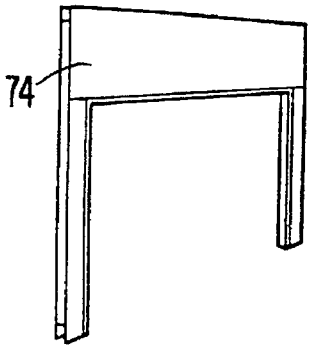
FIG. 5 (PRIOR ART)
FIG. 5 is a perspective view of a double door module which can be used with the so called "studless wall system" to form a clean room.
Figure 6:
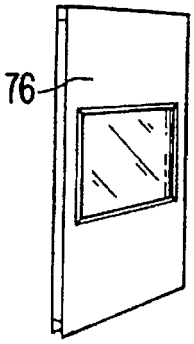
FIG. 6 (PRIOR ART)
FIG. 6 is a perspective view of a window panel module which can be used with the so called "studless wall system" to form a clean room.
Figure 7:
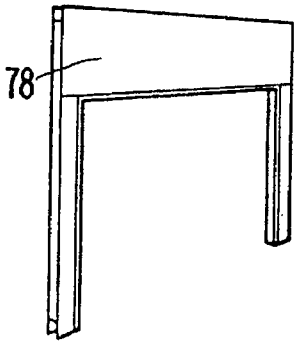
FIG. 7 (PRIOR ART)
FIG. 7 is a perspective view of an auto door module which can be used with the so called "studless wall system" to form a clean room.
Figure 8:
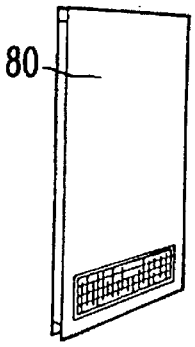
FIG. 8 (PRIOR ART)
FIG. 8 is a perspective view of an air return panel which can be used with the so called "studless wall system" to form a clean room.
Figure 9:
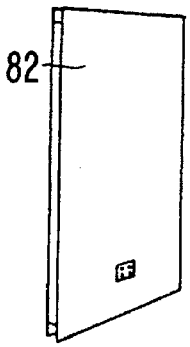
FIG. 9 (PRIOR ART)
FIG. 9 is a perspective view of a pre-wired panel which can be used with the so called "studless wall system" to form a clean room.
Figure 10:
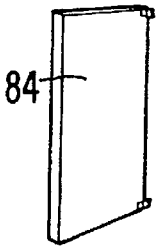
FIG. 10 (PRIOR ART)
FIG. 10 is a perspective view of a solid door which can be used with the so called "studless wall system" to form a clean room.
Figure 11:
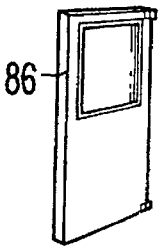
FIG. 11 (PRIOR ART)
FIG. 11 is a perspective view of a half glazed door which can be used with the so called "studless wall system" to form a clean room.
Figure 12:
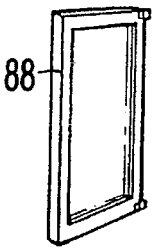
FIG. 12 (PRIOR ART)
FIG. 12 is a perspective view of a full glazed door which can be used with the so called "studless wall system" to form a clean room.
Figure 15:
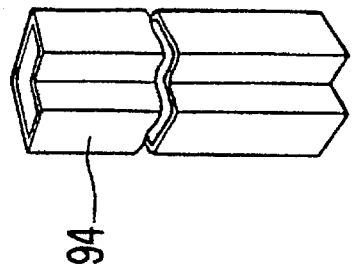
FIG. 15 (PRIOR ART)
FIG. 15 is a perspective view of an I/O corner tube which can be used with the types of construction shown in FIGS. 3 to 11 to form a clean room.
Figure 14:
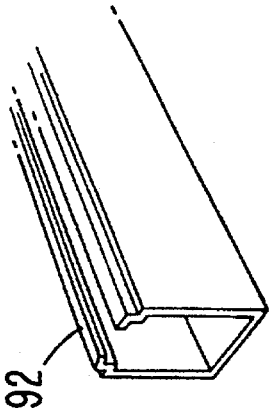
FIG. 14 (PRIOR ART)
FIG. 14 is a perspective view of a floor track which can be used with the types of panels/structures shown in FIGS. 3 to 11 to form a clean room.
Figure 13:
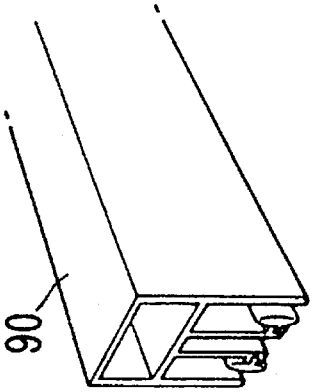
FIG. 13 (PRIOR ART)
FIG. 13 is a perspective view of a head track which can be used with the so called "studless wall system" to form a clean room.
Figure 17:
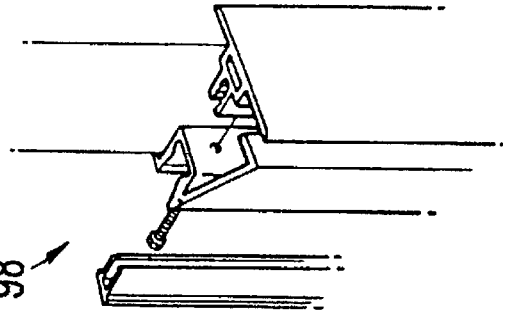
FIG. 17 (PRIOR ART)
FIG. 17 is a perspective view of a glazing batten set which can be used in connection with studless wall system type constructions.
Figure 16:
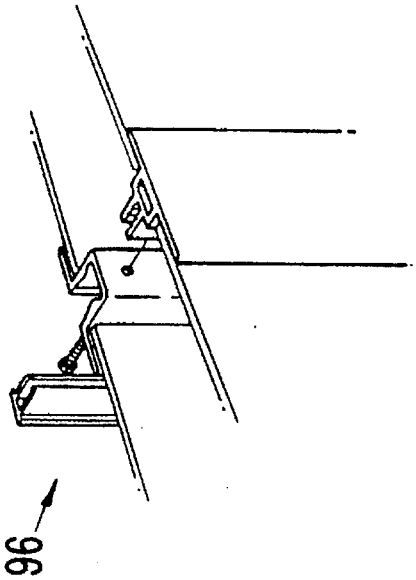
FIG. 16 (PRIOR ART)
FIG. 16 is a perspective view showing a 3-piece batten set which can be used with studless wall systems.
Figure 19:
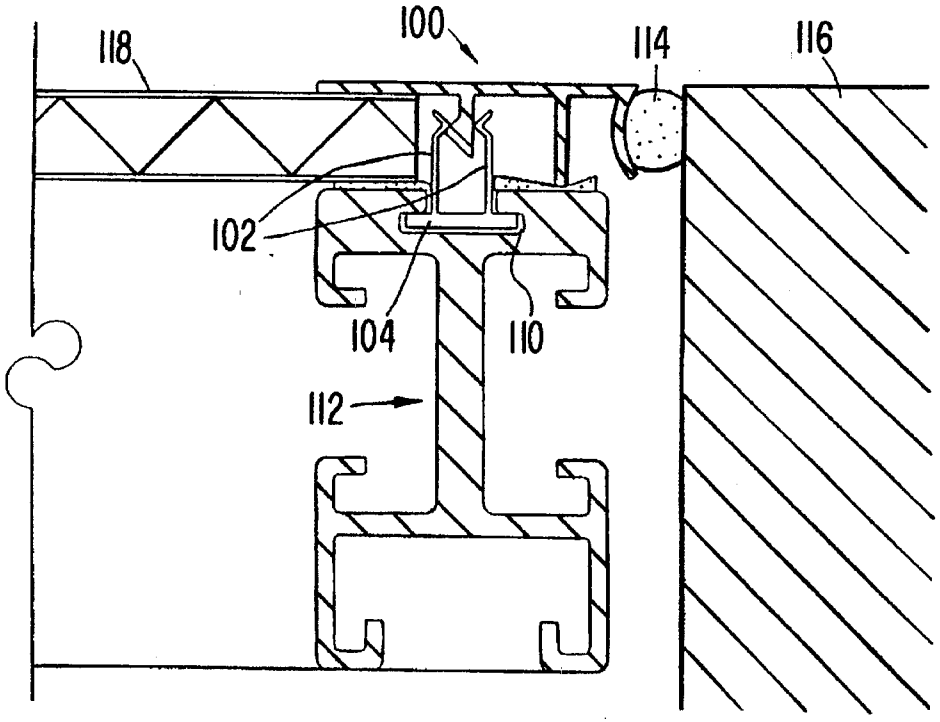
FIG. 19 (PRIOR ART)
FIG. 19 is a partially sectioned view showing the trim member shown in FIG. 18, used to dress-off the interface defined at the intersection of a wall panel and an existing wall.
Figure 18:
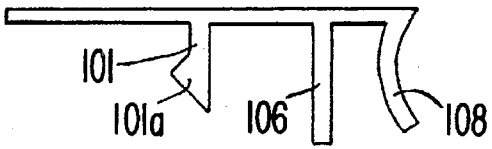
FIG. 18 (PRIOR ART)

FIG. 25 shows a wall end cap bulkhead trim member which is arranged to dress off a corner where a wall panel meets an existing wall member of a structure in which the clean room is being constructed. This trim includes a channel member 652, a double barbed connection member 654, a support arm 656 and a seal seat 651. It should be noted at this point that the provision of the double barb 654*a* helps to prevent the rotational tendency exhibited by the prior art arrangement shown in FIG. 18. The provision of the channel or receiving member 652 of course further strongly resists rotation.

Figure 26:
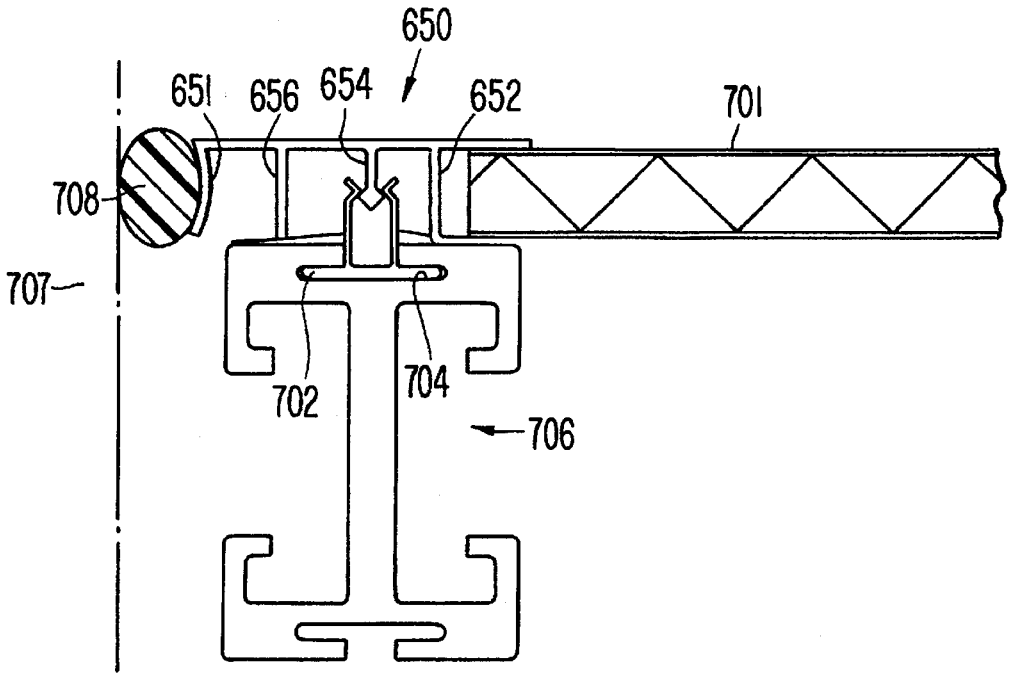
FIG. 26 is a plan view showing an application of the trim according to the sixth embodiment of the present invention.

FIG. 26 shows an application of the wall end cap bulkhead trim 650 shown in FIG. 25. As shown, in this environment the trim 650 is fitted onto an edge of a 0.5" panel 701 and then pressed into position into what shall be referred to as a "double finger T-clip" 702 which is received in a T-channel 704 formed in the stud member 706. A silicon rope 708 or the like type of elastomeric seal member can be fitted into the seal seat 651 prior to the trim being pressed into position, or can be alternatively fixed to the wall member 707 and the trim then pressed into position. It is of course within the scope of the present invention to use a strip of foam material which is provided with an adhesive edge or edges which enables the strip to be set in place on the seal seat.

Figure 27:
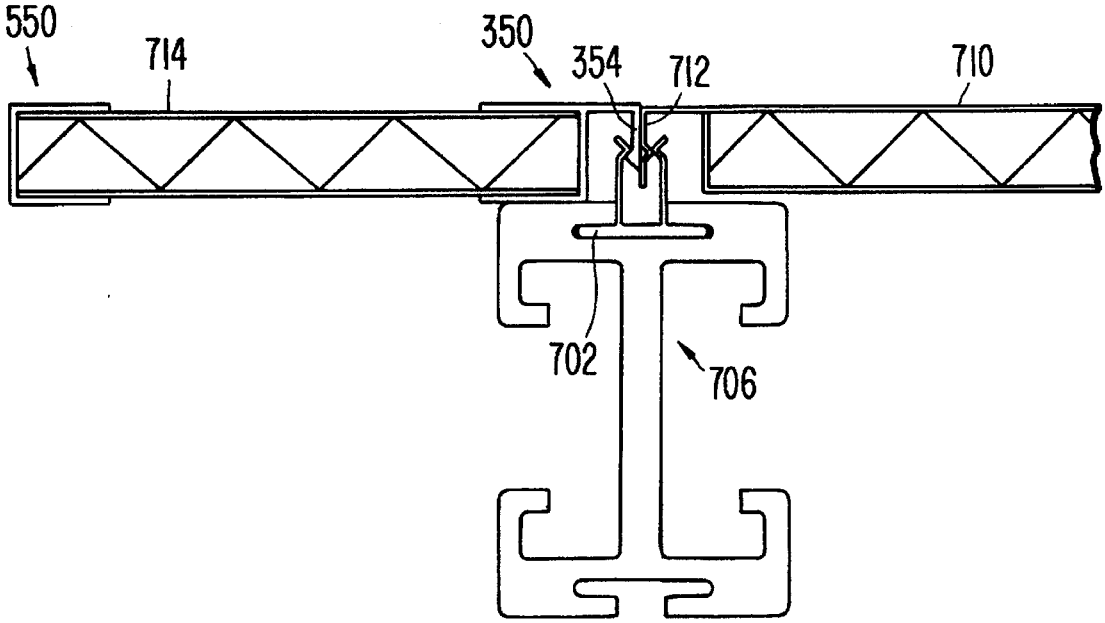
FIG. 27 is a plan view showing an application of the trim according to the third embodiment

FIG. 27 shows the use of a trim member 350 shown in FIG. 22 along with a trim member 550 of the type shown in FIG. 24 with a plain panel and a combination of this arrangement with a proprietary type panel 710 which is marketed by DAW Technologies Inc., of Salt Lake City, Utah, and which is provided with a special connection flange 712 along at least one of its edges. As will be appreciated from FIG. 27, the double-finger T-clip 702 is such that it can grasp both the single barbed member 354 and the connection flange 712. By proving only a single barb on the barbed connection member 354 of the trim member 350, it is possible for the barbed member 354 and the connection flange 712 to gaplessly abut one another and thus provide an aesthetic closure to the gap which exists between the ends of the two panels.

As will be appreciated, this trim arrangement allows a panel produced by one company (i.e. one having a propriety connection flange 712 formed thereon) to be used in combination with a panel 714 produced by another without the need to consider a change in the stud 706 or the double-finger T-clip 702 constructions. The increase in design flexibility and the ease with which existing panels can be reused or interchanged will be immediately be recognized by those skilled in the art to which the instant invention pertains.

Figure 28:
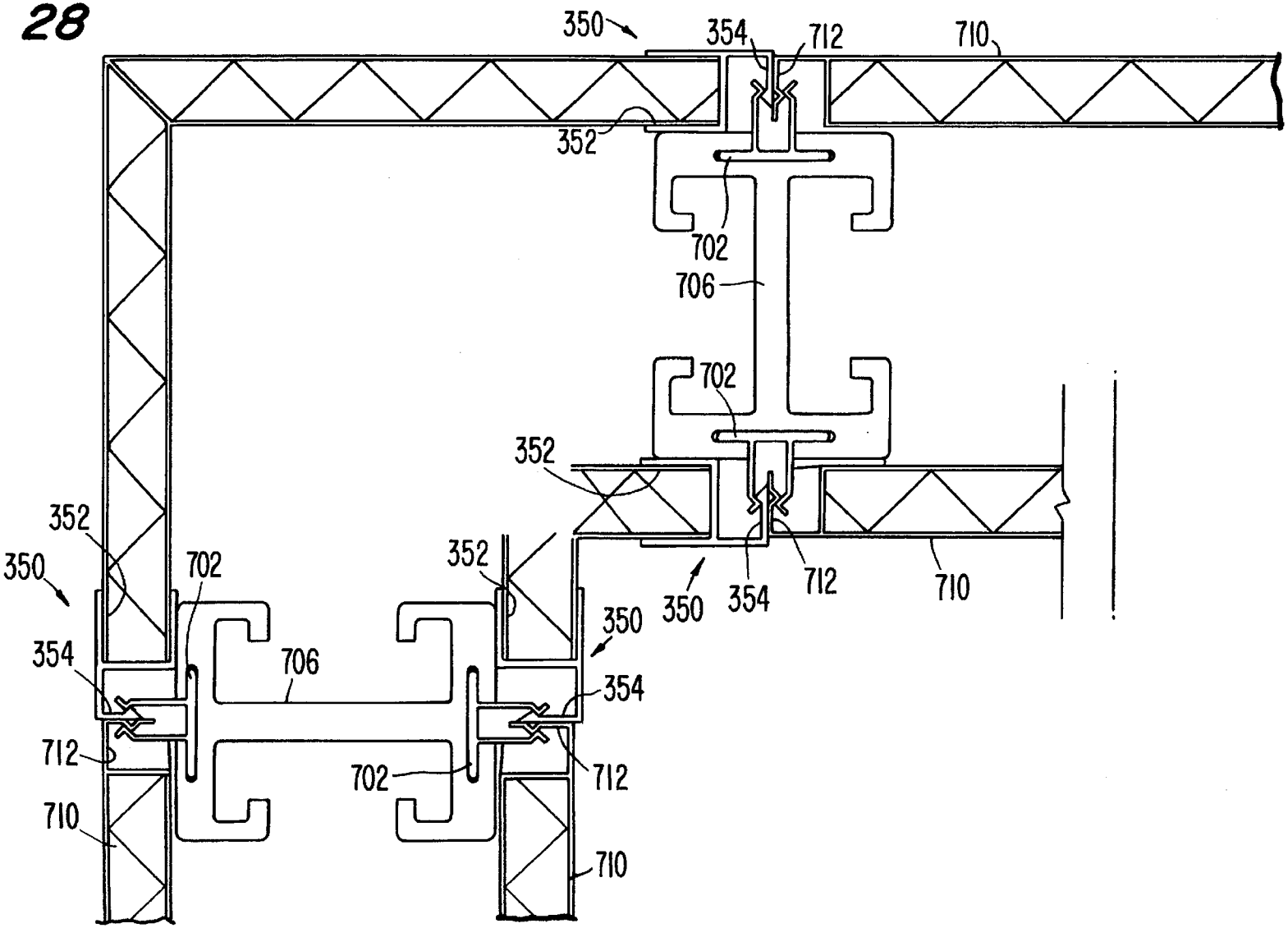
FIG. 28 is a plan view showing the application of the trim according to the third embodiment applied in a construction which forms a corner of a clean room.

FIG. 28 shows the application of the type of trim 350 shown in FIG. 22, in a corner construction. As shown, the inner and outer wall panels are clipped to studs 706 using the same combination as illustrated in FIG. 27.

Figure 29:
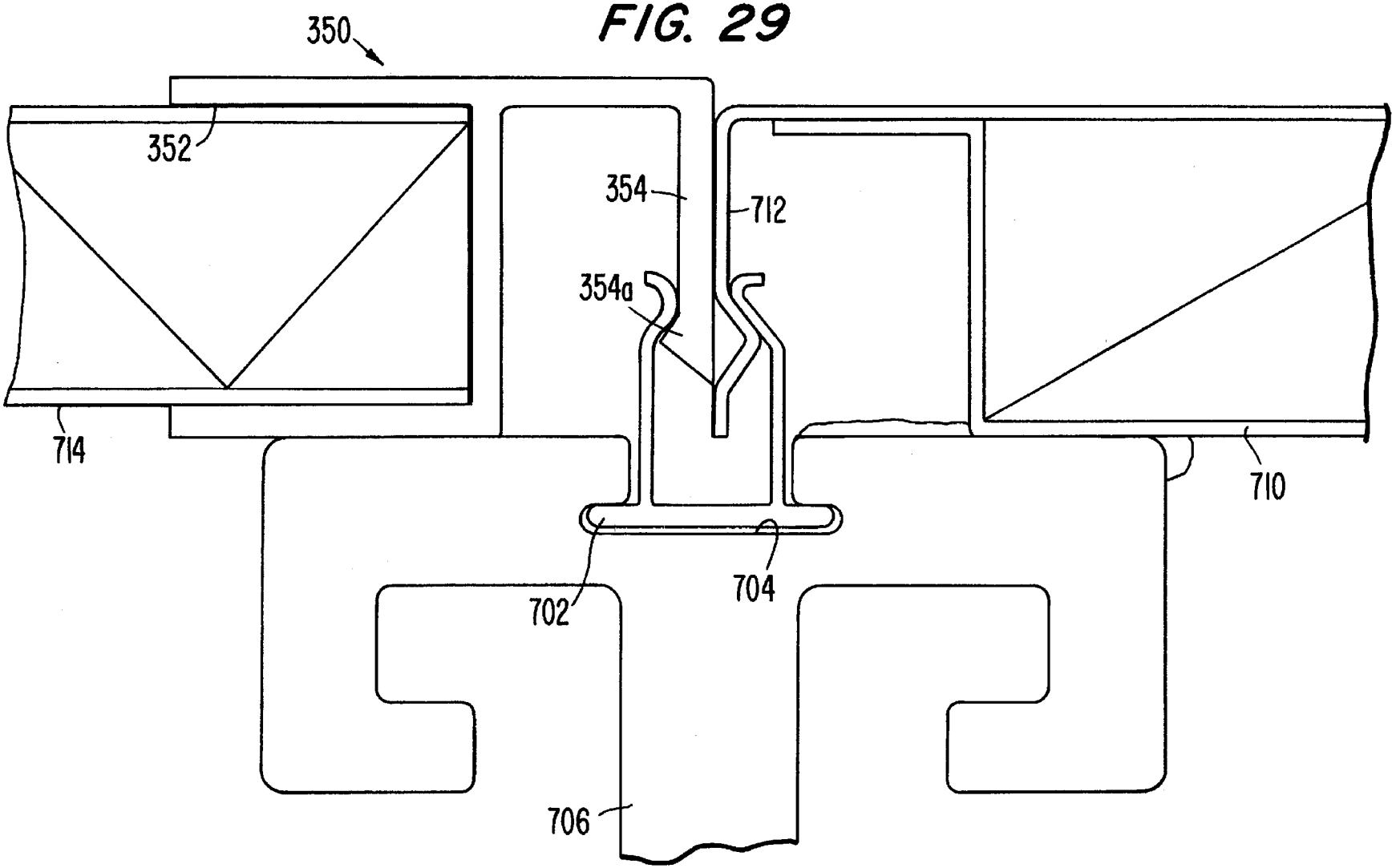
FIG. 29 is an enlarged view showing details of the trim arrangement depicted in FIGS. 27 and 28.

FIG. 29 is an enlarged view showing the manner in which the proprietary panel 710 having the connection flange 712 can be combined with a wall panel 714 which is not provided with such a connection flange 712. As will be appreciated, the cost of a panel 710 having the connection flange 712 integrally formed therewith is considerably higher than one which is not provided with such a flange. In fact, is possible to use plastic covered rock board under many circumstances. This type of board is of course much less expensive than the proprietary panels and thus the ready introduction of a number of these types of panels can mean considerable reductions in construction costs.

Figure 30:
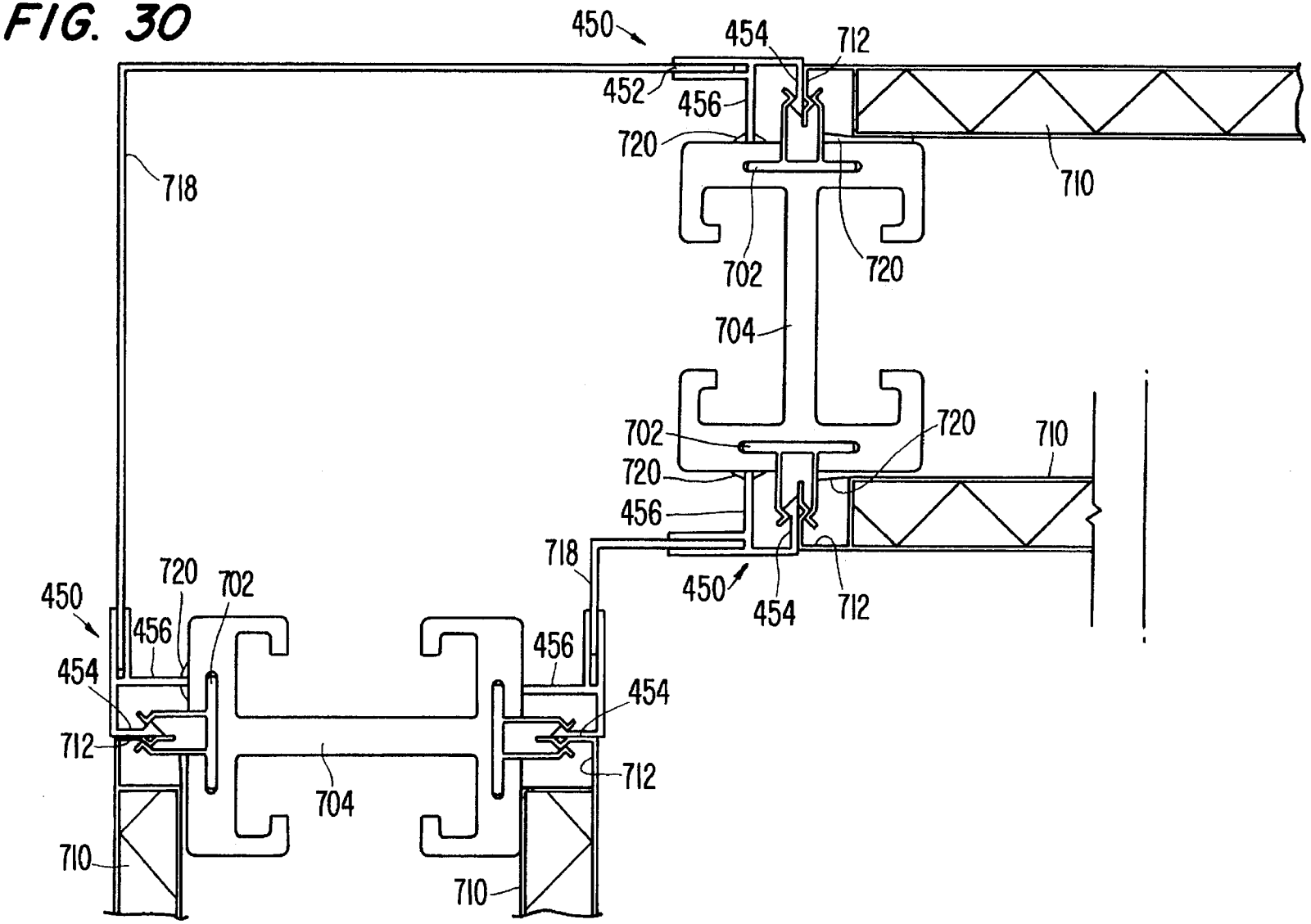
FIG. 30 is plan view showing the application of a fourth embodiment of the present invention in a corner construction wherein the corner portion of the room is formed from relatively thin panels.

FIG. 30 shows an example of a corner construction wherein a thinner type of panel 718 is combined with the thicker proprietary type wall panel. In this instance, trims 450 of the nature illustrated in FIG. 23 are used. As this construction is essentially identical to that shown in FIG. 28, the constructional features will therefore not be redundantly reiterated. It is, however, worth noting that strips of foam type gasket material 720 can be applied along the length of the studs 706 so as to enable the free end of the support arm 456 of the trims to be pressed thereinto and thus provide both a seal and a resilient reaction member.

Figure 31:
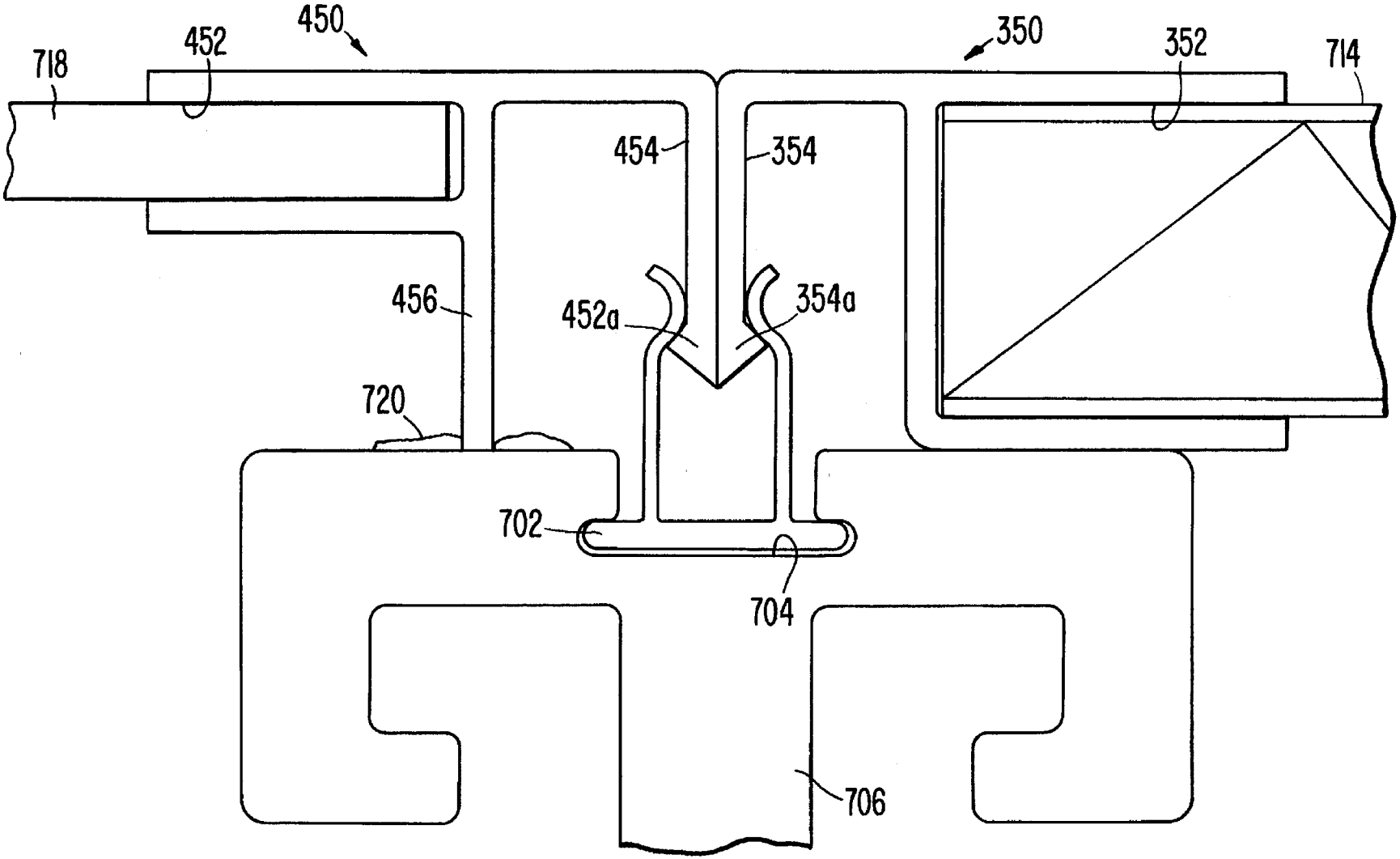
FIG. 31 is a plan view showing the application of trims according to third and fourth embodiments in combination to allow a wall construction which is in part formed of a thin panel and which in part is formed of a thicker panel.

FIG. 31 is an enlarged view showing the use of trims 350, 450 shown in FIGS. 22 and 23 in a back-to-back configuration. The single barb arrangements of the barbed members 352, 354 are received by the double-finger T-clip 702 in the illustrated manner. The two trims 350, 450 are therefore held together in a manner which prevents any gaps between the two trims 350, 450 and thus provides aesthetic sealing arrangements.

Figure 32:
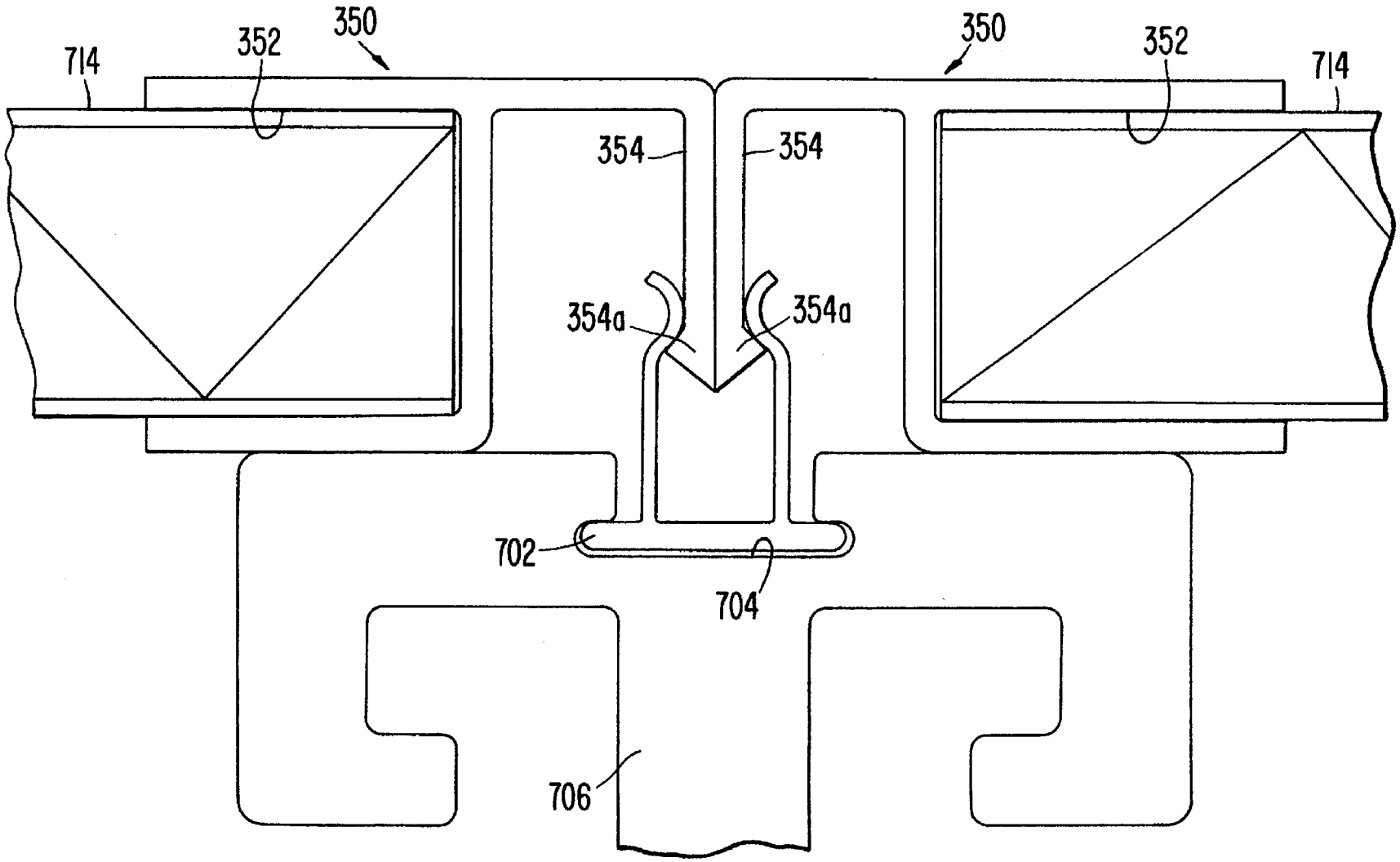
FIG. 32 is a plan view showing the back to back usage of two trims according to the third embodiment in a construction wherein the wall is constructed of thick wall panel members.

FIG. 32 shows two trims 350, 350 of the nature illustrated in FIG. 22, used in a face-to-face arrangement to enable two plain-edged wall panels 714, 714 to be clipped to a stud member 706.

Although the arrangements which use the double-finger T-clips 702 have been disclosed in connection with studs, it will be appreciated that the invention is not limited to this type of connection environment and it is within the scope of the present invention to connect the clips directly to an existing wall structure such as a dry wall, or a wall which is made of brick or the like, either by furring the clips to the wall or by slipping the clips into suitably slotted brackets which are furred in position on the wall or existing structure.

It is to be noted that the trims according to the present invention are not limited to vertical joints and can be used along horizontal edges with equal effect. The trims can be made of a variety of different plastics or aluminum, and can be painted with suitable paints such as two part electrically conductive epoxy paint if required.

From the foregoing disclosure it will be appreciated that a large number of connection variations and arrangements are possible without departing from the scope of the present invention which is not limited to the disclosed arrangements, and which is limited only by the appended claims.

What is claimed is:

1. A clean room construction comprising:

a stud having a predetermined shaped slot;

a wall panel which is located adjacent said stud;

a clip member which is detachably received in the predetermined shaped slot formed in said stud; and a trim having a channel-shaped receiving portion which is fitted onto an edge of the panel, said trim having a barbed portion which is arranged to be received by said clip member and to connect and support said wall panel in a predetermined spatial relationship with respect to said stud.

2. A method of constructing a clean room of prefabricated panels and stud members comprising the steps of:

fitting a trim having a channel-like receiving portion onto an edge of a panel;

connecting a clip having a pair of resilient fingers to a stud; and forcing, after said clip is connected to said stud, a barbed portion of said trim between the resilient fingers of said clip in a manner to detachably and supportively connect said panel to said stud.

3. A trim for use in a clean room construction wherein prefabricated panels are connected to a plurality of spaced vertically extending elongate studs, comprising:

a channel-like receiving portion having essentially equilength side portions which is adapted to fit along an edge of a panel; and a barbed portion which extends essentially parallel to and adjacent an end wall of said channel-like receiving portion so as to be in a side-by-side relationship with the end wall, said barbed portion being adapted to be inserted between springy fingers of a clip which is detachably connected with one of the plurality of studs.

4. A clean room wall system comprising:

panel means;

support means to which the panel means is connected;

trim means for dressing an edge of said panel means, said trim means including a channel-like receiving portion which receives an edge of said panel means; and connection means for connecting said trim means to said support means, said trim means being constructed and arranged so that in combination with said connection means, assembly of the clean room wall system can be achieved without the use of bond or screws.

5. A clean room wall system as set forth in claim 1, wherein said trim means further includes a barbed member which is engageable with said connection means.

6. A clean room wall system as set forth in claim 1, wherein said trim means further includes a support arm which engages said support means and prevents relative movement between said panel and said trim means.

7. A clean room wall system as set forth in claim 6, wherein said support arm is provided when the width of the channel-like member is less than a predetermined value.

8. A clean room wall system as set forth in claim 4, wherein said trim means further includes a seal support member which is adapted to engage a resilient sealing member.

9. A clean room wall system as set forth in claim 4, wherein said trim means further includes:

a barbed member which is engageable with said connection means;

a support arm which engages said support means and prevents relative movement between said panel means and said trim means, and a seal support member which is adapted to engage a resilient sealing member.

10. A clean room wall system as set forth in claim 5, wherein said barbed member has a single barbed end.

11. A clean room wall system as set forth in claim 5, wherein said barbed member has a double barbed end.

12. A clean room wall system as set forth in claim 4, wherein said connection means comprises a clip with a pair springy arms.

13. A clean room wall system as set forth in claim 12, wherein said pair of springy arms are such that each arm is a mirror image of the other of said arms.

14. A clean room wall system as set forth in claim 4, wherein said connection means is detachably connected with a stud member.

15. A clean room wall system as set forth in claim 4, wherein said connection means is detachably connected with a wall which forms part of an existing structure in which the clean room wall system is being constructed.

16. A clean room wall system as set forth in claim 4, wherein said trim means is made of one of plastic and metal.

17. A clean room wall system as set forth in claim 4, wherein said trim means is painted with an electrically conductive paint.

18. A clean room wall system as set forth in claim 17, wherein said electrically conductive paint is a two part epoxy paint.

19. A clean room wall system as set forth in claim 4, further comprising a seal seat which is curved and adapted to receive or engage an elongate elastomeric seal member.

* * * * *